US008443590B2

(12) United States Patent
Gonze et al.

(10) Patent No.: US 8,443,590 B2
(45) Date of Patent: May 21, 2013

(54) REDUCED VOLUME ELECTRICALLY HEATED PARTICULATE FILTER

(75) Inventors: Eugene V. Gonze, Pinckney, MI (US); Michael J. Paratore, Jr., Howell, MI (US)

(73) Assignee: GM Global Technology Operations LLC

( * ) Notice: Subject to any disclaimer, the term of this patent is extended or adjusted under 35 U.S.C. 154(b) by 138 days.

(21) Appl. No.: 12/496,939

(22) Filed: Jul. 2, 2009

(65) Prior Publication Data

US 2011/0000195 A1 Jan. 6, 2011

(51) Int. Cl.
*F01N 3/027* (2006.01)

(52) U.S. Cl.
USPC ..... 60/286; 60/295

(58) Field of Classification Search
USPC ..... 60/289, 320, 299, 286, 295, 311
See application file for complete search history.

(56) References Cited

U.S. PATENT DOCUMENTS

| | | | |
|---|---|---|---|
| 4,404,795 | A | 9/1983 | Oishi et al. |
| 4,404,796 | A | 9/1983 | Wade |
| 4,427,418 | A | 1/1984 | Kogiso et al. |
| 4,516,993 | A | 5/1985 | Takeuchi et al. |
| 4,549,395 | A | 10/1985 | Dammann |
| 4,549,398 | A | 10/1985 | Oishi et al. |
| 4,685,290 | A | 8/1987 | Kamiya et al. |
| 5,144,798 | A | 9/1992 | Kojima et al. |
| 5,171,335 | A | 12/1992 | Kojima et al. |
| 5,195,316 | A | 3/1993 | Shinzawa et al. |
| 5,207,807 | A | 5/1993 | Manfre et al. |
| 5,458,673 | A | 10/1995 | Kojima et al. |
| 5,472,462 | A | 12/1995 | Pischinger et al. |
| 5,616,835 | A | 4/1997 | Schnaibel et al. |
| 5,711,149 | A | 1/1998 | Araki |
| 5,716,586 | A | 2/1998 | Taniguchi |
| 5,732,550 | A | 3/1998 | Muramatsu et al. |
| 5,839,279 | A | 11/1998 | Moriya et al. |
| 6,013,118 | A | 1/2000 | Matsunuma et al. |
| 6,050,086 | A | 4/2000 | Ishizuka et al. |
| 6,090,172 | A | 7/2000 | Dementhon et al. |
| 6,167,696 | B1 | 1/2001 | Maaseidvaag et al. |
| 6,176,896 | B1 | 1/2001 | Dementhon et al. |
| 6,405,528 | B1 | 6/2002 | Christen et al. |
| 6,634,170 | B2 | 10/2003 | Hiranuma et al. |
| 6,769,246 | B2 | 8/2004 | Strohmaier et al. |
| 6,781,098 | B2 | 8/2004 | Toyoda |

(Continued)

FOREIGN PATENT DOCUMENTS

| | | |
|---|---|---|
| CN | 1535351 | 10/2004 |
| CN | 1540143 A | 10/2004 |

(Continued)

*Primary Examiner* — Thomas Denion
*Assistant Examiner* — Jonathan Matthias

(57) ABSTRACT

A control system comprises an exhaust treatment system, an electric heating module, and an exhaust heating module. The exhaust treatment system comprises a particulate matter (PM) filter and an electric heater. The PM filter includes M zones that receive exhaust gas of an engine and filter PM from the exhaust gas. The electric heater heats exhaust gas input to N of the M zones, wherein M is an integer greater than one and N is an integer less than M. The electric heating module activates the electric heater to heat exhaust gas input to the N zones to regenerate the N zones. The exhaust heating module heats exhaust gas input to the M zones by controlling an air-fuel ratio of the exhaust gas after the N zones regenerate.

10 Claims, 6 Drawing Sheets

U.S. PATENT DOCUMENTS

| | | | |
|---|---|---|---|
| 6,973,778 | B2 | 12/2005 | Kondou et al. |
| 7,062,904 | B1 | 6/2006 | Hu et al. |
| 7,073,326 | B2 | 7/2006 | Cheong |
| 7,111,455 | B2 | 9/2006 | Okugawa et al. |
| 7,146,804 | B2 | 12/2006 | Yahata et al. |
| 7,171,801 | B2 | 2/2007 | Verkiel et al. |
| 7,288,137 | B2 | 10/2007 | Iyer et al. |
| 7,340,887 | B2 | 3/2008 | Ante et al. |
| 7,412,822 | B2 | 8/2008 | Zhan et al. |
| 7,607,295 | B2 | 10/2009 | Yokoyama et al. |
| 7,615,725 | B2 | 11/2009 | Kosaka et al. |
| 7,631,493 | B2 | 12/2009 | Shirakawa et al. |
| 7,685,811 | B2 | 3/2010 | Taylor et al. |
| 7,794,528 | B2 | 9/2010 | Tochikawa et al. |
| 7,886,529 | B2 | 2/2011 | Gonze et al. |
| 7,896,956 | B2 | 3/2011 | Takase et al. |
| 7,901,475 | B2 | 3/2011 | Gonze et al. |
| 8,037,673 | B2 | 10/2011 | Gonze et al. |
| 8,146,350 | B2 | 4/2012 | Bhatia et al. |
| 8,292,987 | B2 | 10/2012 | Gonze et al. |
| 2003/0000188 | A1 | 1/2003 | Harada et al. |
| 2003/0113249 | A1 | 6/2003 | Hepburn et al. |
| 2003/0131592 | A1 | 7/2003 | Saito et al. |
| 2004/0134187 | A1 | 7/2004 | Inoue et al. |
| 2004/0194450 | A1 | 10/2004 | Tanaka et al. |
| 2005/0072141 | A1 | 4/2005 | Kitahara |
| 2005/0198944 | A1 | 9/2005 | Saitoh et al. |
| 2006/0075731 | A1 | 4/2006 | Ohno et al. |
| 2006/0254265 | A1 | 11/2006 | Odajima et al. |
| 2007/0062181 | A1 | 3/2007 | Williamson et al. |
| 2007/0137186 | A1 | 6/2007 | Igarashi |
| 2007/0214778 | A1* | 9/2007 | Narita et al. ..... 60/299 |
| 2007/0220869 | A1 | 9/2007 | Gonze et al. |
| 2007/0220870 | A1 | 9/2007 | Gonze et al. |
| 2007/0227104 | A1 | 10/2007 | Gonze et al. |
| 2007/0245721 | A1 | 10/2007 | Colignon |
| 2008/0041035 | A1 | 2/2008 | Sawada et al. |
| 2008/0083212 | A1 | 4/2008 | Ament et al. |
| 2008/0295483 | A1 | 12/2008 | Scaife et al. |
| 2009/0064664 | A1* | 3/2009 | Hirata et al. ..... 60/286 |
| 2009/0071128 | A1 | 3/2009 | Gonze et al. |
| 2009/0113883 | A1* | 5/2009 | Bhatia et al. ..... 60/320 |
| 2009/0158715 | A1 | 6/2009 | Stroh et al. |
| 2009/0183501 | A1 | 7/2009 | Gonze et al. |
| 2009/0288398 | A1 | 11/2009 | Perfetto et al. |
| 2010/0095657 | A1 | 4/2010 | Gonze et al. |
| 2010/0126145 | A1 | 5/2010 | He et al. |

FOREIGN PATENT DOCUMENTS

| | | | |
|---|---|---|---|
| CN | 101091038 | A | 12/2007 |
| CN | 101429884 | A | 5/2009 |
| DE | 102008046706 | | 4/2009 |
| DE | 102008046924 | | 4/2009 |
| DE | 102008046924 | A1 | 4/2009 |
| DE | 102008050169 | | 5/2009 |
| GB | 2454341 | A | 6/2009 |
| JP | 06-221138 | | 8/1994 |
| JP | 2000297625 | A | 10/2000 |

* cited by examiner

REDUCED VOLUME ELECTRICALLY HEATED PARTICULATE FILTER

FIELD

The present disclosure relates to engine control systems, and more particularly to electrically heated particulate filters.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Engines such as diesel engines and compression ignition engines may produce particulate matter (PM) that is filtered from exhaust gas and collected by a PM filter. The PM filter is disposed in an exhaust system of the engine. The PM filter reduces emissions of PM generated during combustion. Over time, the PM filter becomes full. During a process called regeneration, the PM may be burned within the PM filter.

Regeneration may involve heating the PM filter to a combustion temperature of the PM. Regeneration may be performed using an exhaust heating technique or using an electrical heating technique. The exhaust heating technique refers to the heating of the exhaust gas, for example, by post-combustion injection of fuel. Fuel may be injected into the cylinder during the combustion cycle and after ignition of the air/fuel mixture or into the exhaust stream. When introduced during or after ignition and/or exhaust strokes of the combustion cycle, the injected fuel, referred to as post-injected (PI) fuel, mixes with the exhaust gas and is oxidized by an oxidation catalyst disposed in the exhaust system. The heat released from the reaction in the oxidation catalyst increases the temperature of the exhaust gas flowing through the PM filter, which ignites particulates in the PM filter.

A typical exhaust heating technique may be limited to an exhaust gas temperature that permits slow, controlled burning of the PM. The typical exhaust heating technique may regenerate the PM filter in 20-30 minutes. Exhaust temperatures during the typical exhaust heating technique may range from approximately 550° C. to 650° C., depending on the amount of PM in the PM filter. For example only, when the exhaust gas temperature is greater than approximately 650° C. and the PM filter is full, the PM may combust too quickly and release too much heat. The heat may cause thermal stress on the PM filter due to rapid expansion of a substrate of the PM filter. The thermal stress may cause damage to the PM filter. Therefore, the exhaust gas temperature is controlled to be less than a thermal stress temperature, typically less than approximately 650° C.

The electrical heating technique refers to the electrical heating of the exhaust gas entering the PM filter. One or more electrical coils may be disposed upstream from the PM filter and may be activated to heat the exhaust gas. The electrical heating technique provides a quick heating and light-off of the PM. The electrical heating technique may also provide a more uniform and controlled burn of the PM in the PM filter.

SUMMARY

An exhaust treatment system comprises a particulate matter (PM) filter and an electric heater. The PM filter receives exhaust gas of an engine and filters PM from the exhaust gas, wherein the PM filter includes M zones. The electric heater heats exhaust gas input to N of the M zones, wherein M is an integer greater than one and N is an integer less than M. In other features, the N zones include an axially centered portion of the PM filter, and the other ones of the M zones include a remaining portion of the PM filter surrounding the N zones.

A control system comprises the exhaust treatment system, an electric heating module, and an exhaust heating module. The electric heating module activates the electric heater to heat exhaust gas input to the N zones to regenerate the N zones. The exhaust heating module heats exhaust gas input to the M zones by controlling an air-fuel ratio of the exhaust gas after the N zones regenerate.

In other features, the electric heating module activates the electric heater for a predetermined period. In still other features, the electric heating module activates the electric heater until PM in the N zones reaches a predetermined temperature.

In still other features, the exhaust heating module heats the exhaust gas to a predetermined temperature to regenerate the other ones of the M zones. The predetermined temperature causes PM in the other ones of the M zones to combust. The predetermined temperature is greater than 650° C. In other features, the predetermined temperature is greater than 700° C.

In yet other features, the exhaust heating module adjusts the air-fuel ratio by injecting fuel into at least one of a cylinder of the engine and an exhaust system. The engine outputs the exhaust gas to the PM filter through the exhaust system.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
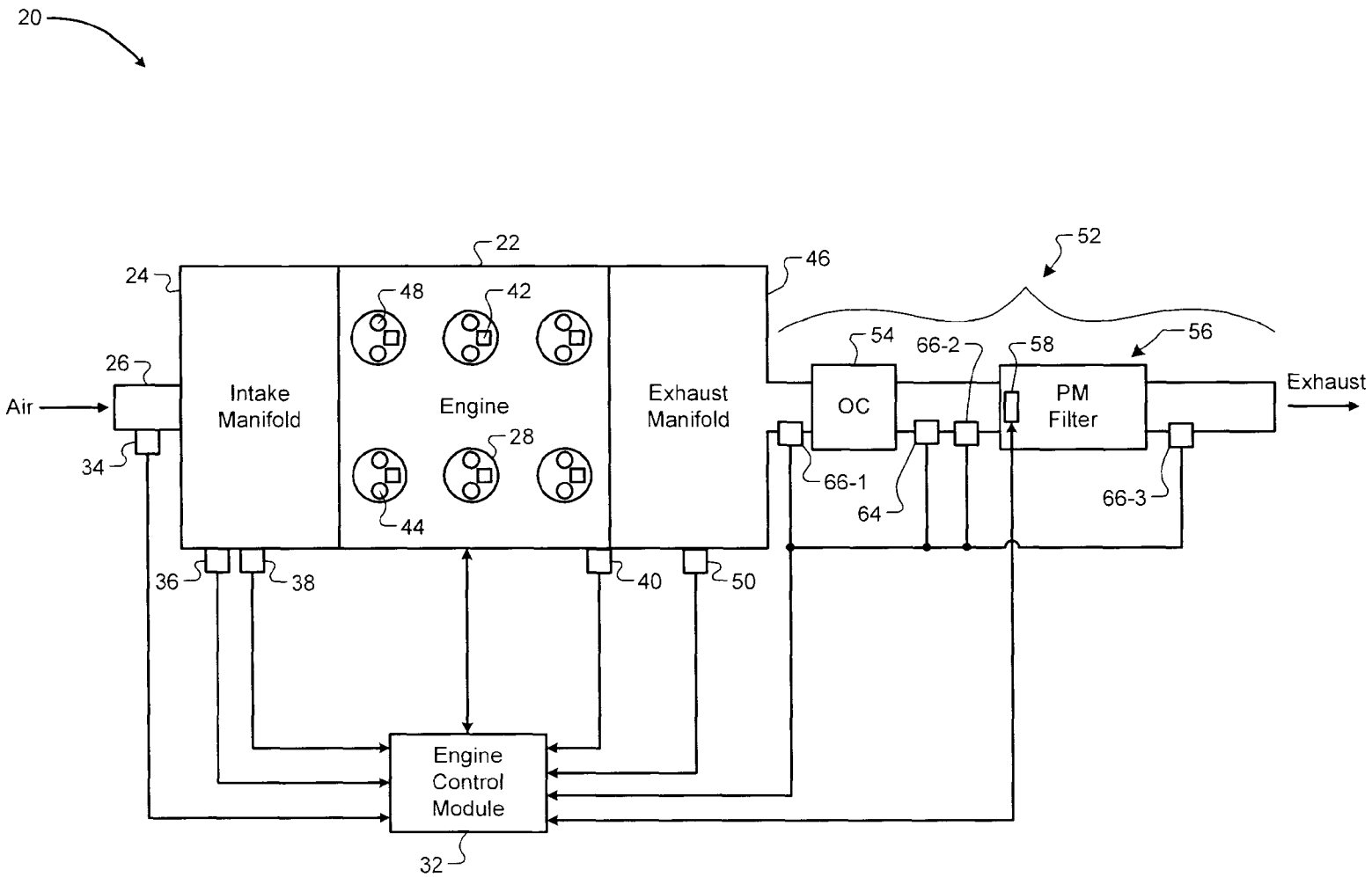
FIG. 1 is a functional block diagram of an exemplary engine system including an electrically heated particulate filter according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

The electrical heating technique requires multiple electric heaters (or individually controlled segments of a single heater) covering an inlet of the PM filter. The electric heaters increase costs of producing the PM filter. The electric heaters may have problems with durability. Power to heat the electric heaters may be significant.

When the PM filter is full of particulates, the exhaust heating technique may be limited to an exhaust temperature that permits slow, controlled burning of the PM. For example only, if the PM burns too quickly, thermal stresses inside the PM filter may damage the PM filter. Thermal stress may occur due to rapid and/or uneven heating that causes increased expansion in some portions of the PM filter. Therefore, the exhaust temperature is controlled to be less than a thermal stress temperature, such as approximately 650° C.

The present disclosure uses a reduced volume electrical heating technique and a high temperature exhaust heating technique to regenerate the PM filter. A first portion of the PM filter is regenerated using the reduced volume electrical heating technique that includes activating a single electric heater. Regenerating the first portion using a single electric heater reduces costs and durability problems associated with multiple heaters. A remaining second portion is regenerated using the high temperature exhaust heating technique.

Once the first portion completes regeneration, thermal stress on the PM filter may be reduced when using the high temperature exhaust heating technique to regenerate the second portion. For example only, the high temperature exhaust heating technique of the present disclosure heats the exhaust gas to temperatures greater than 650° C. The amount of time required to regenerate the remaining second portion may be significantly reduced at temperatures greater than 650° C. The remaining second portion may be regenerated more quickly using exhaust temperatures that are greater than the thermal stress temperature.

The first portion may be a center portion that is approximately centered on an axis of the PM filter parallel to the exhaust gas flow direction, extending from an inlet face to an outlet face of the PM filter. The second portion may be arranged at a radial distance from the axis and surrounding the first portion. The inlet of the PM filter includes a first zone and a second zone that correspond to the first and second portions respectively. For example only, the first zone may be an area of the inlet corresponding to the first portion, and the second zone may be an area surrounding the first zone.

The electric heater covers the first zone and does not cover the second zone. The electric heater heats the first zone and/or exhaust entering the first zone and causes a PM combustion wave to travel down channels of the first portion to regenerate the first portion of the PM filter. The electric heater may heat the exhaust gas input to the first zone to a first temperature to initiate regeneration of the first portion. For example only, the electric heater may heat the exhaust gas input to the first zone to a temperature that is greater than approximately 650° C.

Thermal stress on the PM filter, due to expansion of the first portion related to heat released by the combusting PM, may be reduced because only PM in the first portion combusts rather than combustion of PM in the entire PM filter. The remaining second zone receives non-electrically heated exhaust gas, and PM therein does not begin to combust. Temperatures of the second zone may be within a temperature range of the exhaust gas. For example only, the second zone temperature may be approximately 200° C.-450° C. The second portion may mitigate the stress caused by expansion of the first portion.

After the first portion completes regeneration, the second portion of the PM filter surrounding the first portion may be regenerated using the high temperature exhaust heating technique of the present disclosure. The exhaust heating technique of the present disclosure heats the exhaust gas input to the first and the second zones to a second temperature that is greater than a temperature that causes thermal damage to the PM filter when the PM filter is full. For example only, the second temperature may be greater than approximately 650° C.

Thermal stress on the PM filter, due to expansion of the second portion of the PM filter related to heat released by the combusting PM, may be reduced because only PM in the second portion combusts rather than combustion of PM in the entire PM filter. The first portion receives the heated exhaust gas; however, no PM is present in the first portion to combust. Therefore, little or no expansion occurs in the first portion. The first portion may mitigate the stress caused by expansion of the second portion.

Referring now to FIG. 1, an exemplary engine system 20 is schematically illustrated in accordance with the present disclosure. The engine system 20 is merely exemplary in nature. The electrically heated particulate filter described herein may be implemented in various engine systems using a particulate filter. Such engine systems may include, but are not limited to, diesel engine systems, gasoline direct injection engine systems, and homogeneous charge compression ignition engine systems.

The engine system 20 includes an engine 22 that combusts an air/fuel mixture to produce drive torque. Air is drawn into an intake manifold 24 through an inlet 26. A throttle (not shown) may be included to regulate air flow into the intake manifold 24. Air within the intake manifold 24 is distributed into cylinders 28. Although FIG. 1 depicts six cylinders 28, the engine 22 may include additional or fewer cylinders 28. For example, engines having 4, 5, 8, 10, 12, and 16 cylinders are contemplated.

An engine control module (ECM) 32 communicates with components of the engine system 20. The components may include the engine 22, sensors, and actuators as discussed herein. The ECM 32 may implement control of the electrically heated particulate filter of the present disclosure.

Air passes through the inlet 26 through a mass airflow (MAF) sensor 34. The MAF sensor 34 generates a MAF signal that indicates a rate of air flowing through the MAF sensor 34. A manifold pressure (MAP) sensor 36 is positioned in the intake manifold 24 between the inlet 26 and the engine 22. The MAP sensor 36 generates a MAP signal that indicates air pressure in the intake manifold 24. An intake air temperature (IAT) sensor 38 located in the intake manifold 24 generates an IAT signal based on intake air temperature.

An engine crankshaft (not shown) rotates at engine speed or a rate that is proportional to engine speed. A crankshaft sensor 40 senses a position of the crankshaft and generates a crankshaft position (CSP) signal. The CSP signal may be related to the rotational speed of the crankshaft and cylinder events. For example only, the crankshaft sensor 40 may be a variable reluctance sensor. The engine speed and cylinder events may be sensed using other suitable methods.

The ECM 32 actuates fuel injectors 42 to inject fuel into the cylinders 28. An intake valve 44 selectively opens and closes to enable air to enter the cylinder 28. An intake camshaft (not shown) regulates the intake valve position. A piston (not shown) compresses and combusts the air/fuel mixture within the cylinder 28. The piston drives the crankshaft during a power stroke to produce drive torque. Exhaust gas resulting from the combustion within the cylinder 28 is forced out through an exhaust manifold 46 when an exhaust valve 48 is in an open position. An exhaust camshaft (not shown) regulates the exhaust valve position. An exhaust manifold pressure (EMP) sensor 50 generates an EMP signal that indicates exhaust manifold pressure.

An exhaust treatment system 52 may treat the exhaust gas. The exhaust treatment system 52 may include an oxidation catalyst (OC) 54. The OC 54 oxidizes carbon monoxide and hydrocarbons in the exhaust gas. The OC 54 oxidizes the exhaust based on the post combustion air/fuel ratio. The amount of oxidation may increase the temperature of the exhaust.

The exhaust treatment system 52 includes a particulate matter (PM) filter assembly 56. The PM filter assembly 56 may receive exhaust gas from the OC 54 and filter any particulate matter present in the exhaust. An electric heater 58 selectively heats the exhaust and/or a portion of the PM filter assembly 56 to initiate regeneration of the PM. The ECM 32 controls the engine 22 and filter regeneration based on various sensed and/or estimated information.

More specifically, the ECM 32 may estimate a PM filter load based on the sensed and estimated information. The filter load may correspond to an amount of particulate matter in the PM filter assembly 56. The filter load may be based on an exhaust temperature and/or the exhaust flow. Exhaust flow may be based on the MAF signal and fueling of the engine 22. When the filter load is greater than or equal to a filter load threshold, regeneration may be initiated by the ECM 32.

The exhaust treatment system 52 may include a gas sensor 64 and exhaust temperature sensors 66-1, 66-2, 66-3 (collectively exhaust temperature sensors 66). The gas sensor 64 generates a gas level signal that indicates amounts of NOx and/or oxygen in the exhaust gas.

The exhaust temperature sensors 66 generate exhaust temperature signals that indicate temperatures of the exhaust gas. The exhaust temperature sensors 66 may measure temperatures of the exhaust gas before the OC 54 and the PM filter assembly 56. The exhaust temperature sensors 66 may measure temperatures of the exhaust gas after the PM filter assembly 56 and/or between the OC 54 and the PM filter assembly 56. For example only, exhaust temperature sensor 66-2 may measure an inlet exhaust gas temperature of the PM filter assembly 56. The ECM 32 may generate an exhaust temperature model to estimate exhaust temperatures throughout the exhaust treatment system 52.

Figure 2:
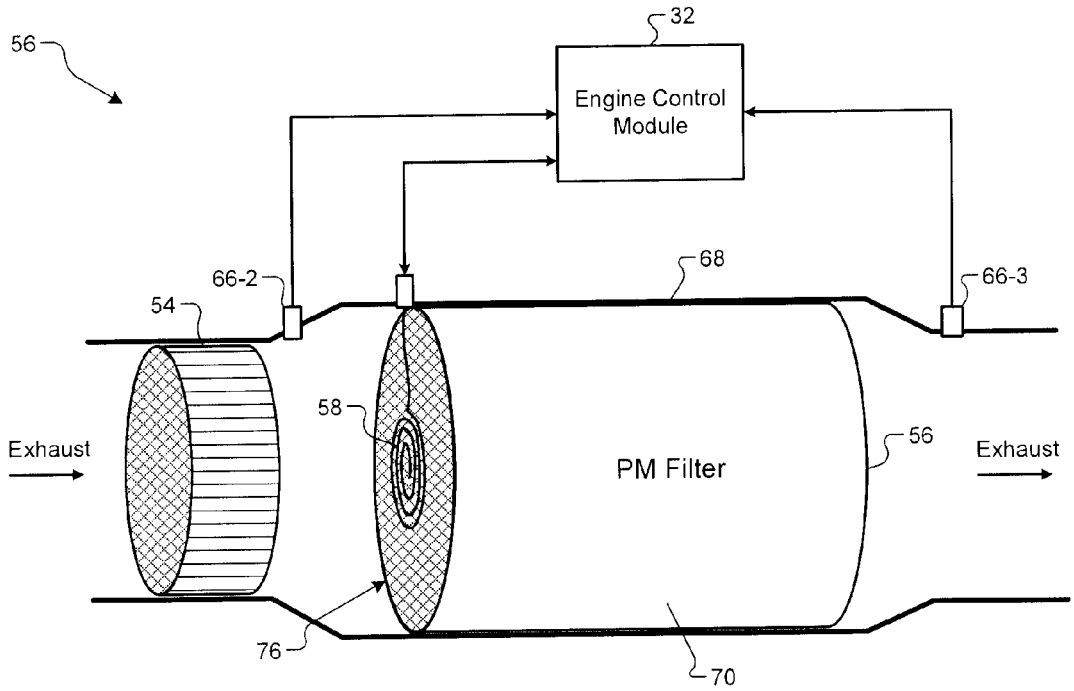
FIG. 2 illustrates the exemplary electrically heated particulate filter according to the principles of the present disclosure.
Figure 4:
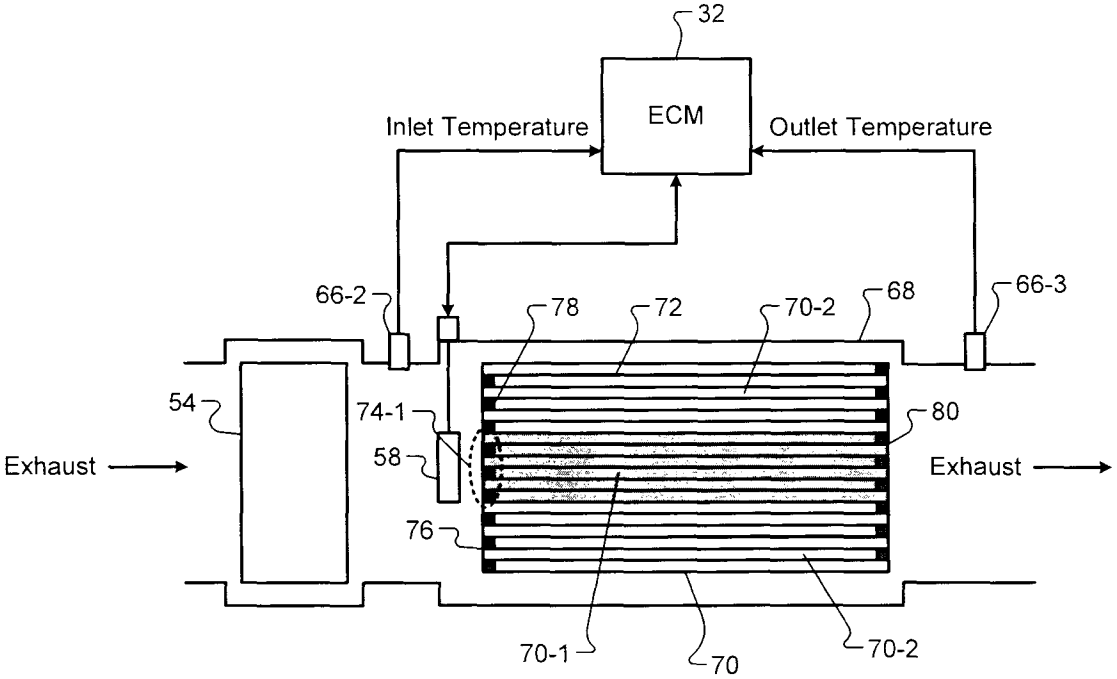
FIG. 4 illustrates regeneration of the exemplary electrically heated particulate filter according to the principles of the present disclosure.

Referring now to FIGS. 2 and 4, an exemplary PM filter assembly 56 is shown. The PM filter assembly 56 may include a housing 68, a PM filter 70, and the electric heater 58. The electric heater 58 may be arranged between the OC 54 and the PM filter 70. The ECM 32 may apply energy or power to the electric heater 58 in the form of voltage or current. The PM filter 70 includes channels 72 through which exhaust gas may flow. PM may be filtered as the exhaust gas passes through the channels 72, leaving PM inside the channels 72.

Figure 3:
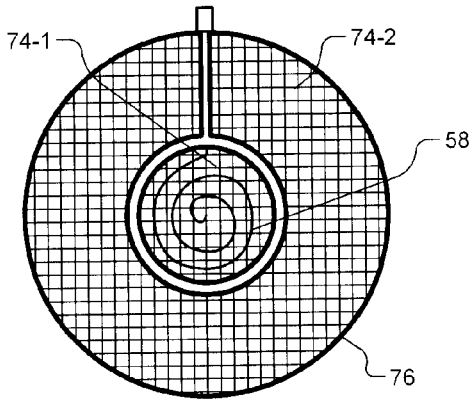
FIG. 3 illustrates an inlet of the exemplary electrically heated particulate filter including a single electric heater according to the principles of the present disclosure.

The electric heater 58 may comprise a coil, a heater segment, or a conductive element that covers a first zone 74-1 of the PM filter 70. The electric heater 58 does not cover a second zone 74-2 of the PM filter 70. Referring now to FIG. 3, an inlet 76 of the PM filter 70 is shown. For example only, the first zone 74-1 may include a center zone that includes an axially centered area of the inlet 76. For example only, the first zone 74-1 may include 50% or less of the area of the inlet 76. The first zone 74-1 may include approximately 20% of the area of the inlet 76. The second zone 74-2 may surround the first zone 74-1 of the PM filter 70. The first zone 74-1 may include an area of the PM filter 70 in contact with the electric heater 58. The first zone 74-1 may include a portion of the PM filter 70 downstream of the electric heater 58, as shown in FIG. 4.

Regeneration may be initiated in the first zone 74-1 by activating the electric heater 58. The electric heater 58 may be activated until a temperature of the first zone 74-1 is greater than or equal to the PM combustion temperature. For example only, PM may combust at a temperature of approximately 600° C.

The ECM 32 initiates regeneration in the first zone 74-1 when the filter load is greater than the filter load threshold. Exhaust gas enters the PM filter 70 from the electric heater 58 through the inlet 76. The ECM 32 may supply power to the electric heater 58 to heat the first zone 74-1. Power may be supplied to the electric heater 58 until the first zone temperature is greater than or equal to the PM combustion temperature. The electric heater 58 may be activated for a predetermined time based on the heater temperature and the inlet exhaust gas temperature measured by sensor 66-2.

The electric heater 58 heats the exhaust gas passing through the electric heater 58 to heat the first zone 74-1. The electric heater 58 may also directly heat the first zone 74-1. When the temperature of the first zone 74-1 is greater than or equal to the PM combustion temperature, PM near the first zone 74-1 ignites and initiates regeneration. For example only, PM may begin to combust behind end plugs 78 in the first zone 74-1.

Regeneration continues through a first filter portion 70-1 corresponding to the first zone 74-1 as the exhaust gas flow advances combusting PM through the first filter portion 70-1. The first filter portion 70-1 may include one or more channels 72 extending from the first zone 74-1 to a PM filter outlet 80. The PM filter 70 may includes a second filter portion 70-2 corresponding to the second zone 74-2.

When the first filter portion 70-1 completes regeneration, the ECM 32 regenerates the second filter portion 70-2 using an exhaust heating technique. The exhaust heating technique may include adjusting the exhaust gas temperature to regenerate the second filter portion 70-2. The ECM 32 may increase the exhaust gas temperature by adjusting fuel entering the engine 22 and/or exhaust treatment system 52. For example only, post-fuel injection may inject fuel into the cylinders 28 and/or the exhaust treatment system 52 using fuel injectors 42. The fuel may be burned using a fuel burner (not shown) and/or a catalytic oxidizer such as the OC 54 to increase the exhaust temperature.

The ECM 32 may increase the exhaust gas temperature to a second temperature that is greater than the PM combustion temperature for a predetermined time to regenerate the second filter portion 70-2. The second temperature may be greater than a temperature that may cause thermal stress to the PM filter 70 when the first filter portion 70-1 is full of PM. For example only, the second temperature may be greater than approximately 650° C.

Because the first filter portion 70-1 has been regenerated, little or no expansion of the first filter portion 70-1 may occur as heated exhaust gas flows there through. Therefore, thermal stresses on the second filter portion 70-2 due to expansion of the first filter portion 70-1 may be reduced. Heating the exhaust gas to the second temperature regenerates the second filter portion 70-2 at a faster rate than when the inlet exhaust gas temperature is less than the second temperature.

Figure 5:
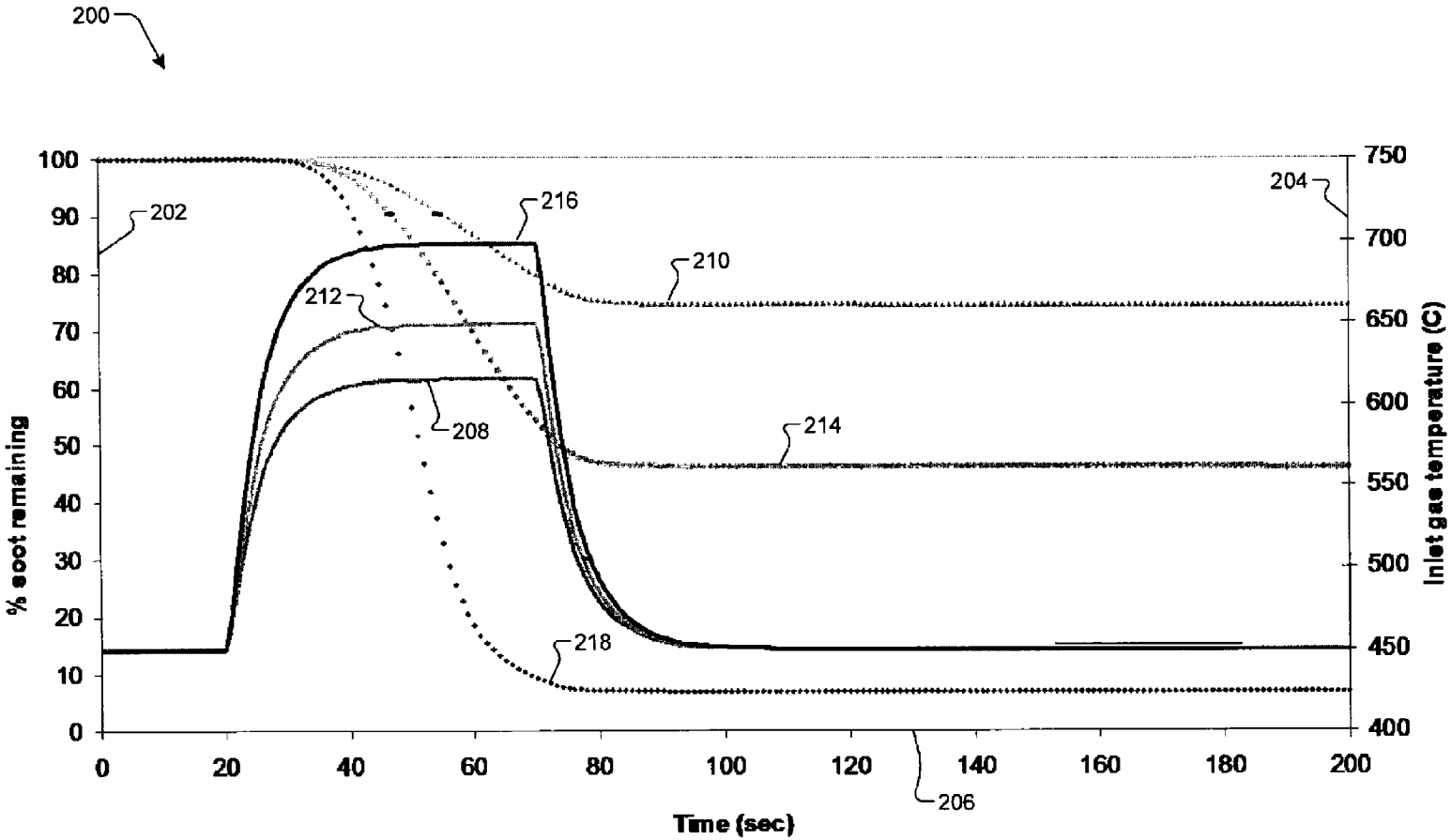
FIG. 5 is a graph illustrating the effect of various exhaust gas temperatures on regeneration of the exemplary electrically heated particulate filter.

Referring now to FIG. 5, a graph 200 illustrates the effect of various inlet exhaust gas temperatures on regeneration times. The graph 200 includes a first y-axis 202 representing a percentage of soot remaining in the PM filter 70. The percentage of soot may correspond to the filter load. A second y-axis 204 represents the inlet exhaust gas temperature in degrees Celsius (° C.). An x-axis 206 represents time in seconds.

Plot 208 illustrates an inlet exhaust gas temperature that increases from approximately 450° C. to approximately 615° C. Plot 210 corresponds to the inlet exhaust gas temperature of plot 208 and illustrates the percentage of soot remaining in the PM filter as time progresses. The inlet exhaust gas temperature is approximately 615° C. during a 30-second period from 40 seconds to 70 seconds. During the 30-second period, the percentage of soot decreases by approximately 20%.

Plot 212 illustrates an inlet exhaust gas temperature that increases from approximately 450° C. to approximately 650° C. Plot 214 corresponds to the inlet exhaust gas temperature of plot 212 and illustrates the percentage of soot remaining in the PM filter as time progresses. The inlet exhaust gas temperature is approximately 650° C. during a 30-second period from 40 seconds to 70 seconds. During the 30-second period, the percentage of soot decreases by approximately 50%.

Plot 216 illustrates an inlet exhaust gas temperature that increases from approximately 450° C. to approximately 700° C. Plot 218 corresponds to the inlet exhaust gas temperature of plot 216 and illustrates the percentage of soot remaining in the PM filter as time progresses. The inlet exhaust gas temperature is approximately 700° C. during a 30-second period from 40 seconds to 70 seconds. During the 30-second period, the percentage of soot decreases by approximately 90%.

As shown in graph 200, the higher the inlet exhaust gas temperature, the faster regeneration of the PM filter 70 may be performed. When the PM filter 70 is full of PM, inlet exhaust gas temperatures greater than approximately 650° C. cause rapid expansion of the PM filter 70 and thermal stress that may damage the PM filter 70. Therefore, the present disclosure electrically heats the first filter portion 70-1 of the PM filter 70 to decrease the amount of PM in the first filter portion 70-1 before heating the exhaust gas to a temperature greater than approximately 650° C. to regenerate the second filter portion 70-2.

Figure 6:
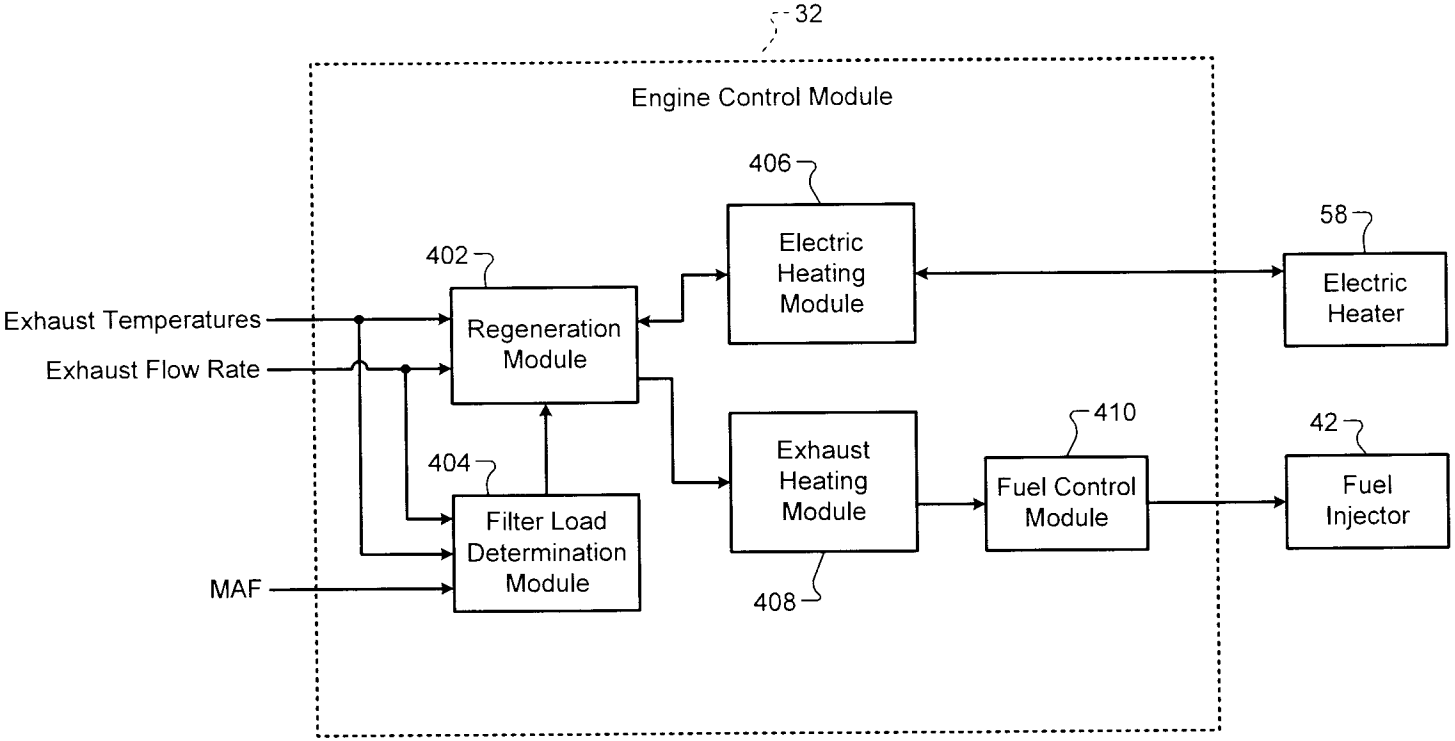
FIG. 6 is a functional block diagram of an exemplary engine control module according to the principles of the present disclosure.

Referring now to FIG. 6, a functional block diagram of an exemplary ECM 32 is presented. The ECM 32 may include a regeneration module 402 that determines when the filter load is greater than the filter load threshold. A filter load determination module 404 may determine the filter load based on the MAF and exhaust gas flow. When the filter load is greater than the filter load threshold, the regeneration module 402 may begin regeneration of the PM filter 70.

The regeneration module 402 may activate an electric heating module 406 to begin regeneration. The electric module activates the electric heater 58 to heat the first zone 74-1 of the PM filter 70. The electric heating module 406 activates the electric heater 58 to heat the exhaust gas to a first temperature until the temperature of the first zone 74-1 is greater than or equal to the PM combustion temperature. For example only, the first temperature may be greater than approximately 650° C. PM in the first zone 74-1 begins to combust. Exhaust gas flow advances the combusting PM through the first filter portion 70-1 of the PM filter 70 until the first filter portion 70-1 completes regeneration.

After regeneration of the first filter portion 70-1 completes, the regeneration module 402 may regenerate the second filter portion 70-2 using exhaust heating. An exhaust heating module 408 may control the exhaust gas temperature by adjusting fuel injection of the engine system 20. For example only, the exhaust heating module 408 may adjust fueling by a fuel control module 410 to increase the inlet exhaust gas temperature to a second temperature when regeneration of the first filter portion 70-1 is complete. The fuel control module 410 may adjust the amount of fuel injected by fuel injectors 42 and/or timing of the fuel injections. The second temperature may be greater than the thermal stress temperature that causes thermal stress when the PM filter 70 is full of PM. For example only, the second temperature may be greater than approximately 650° C.

Figure 7:
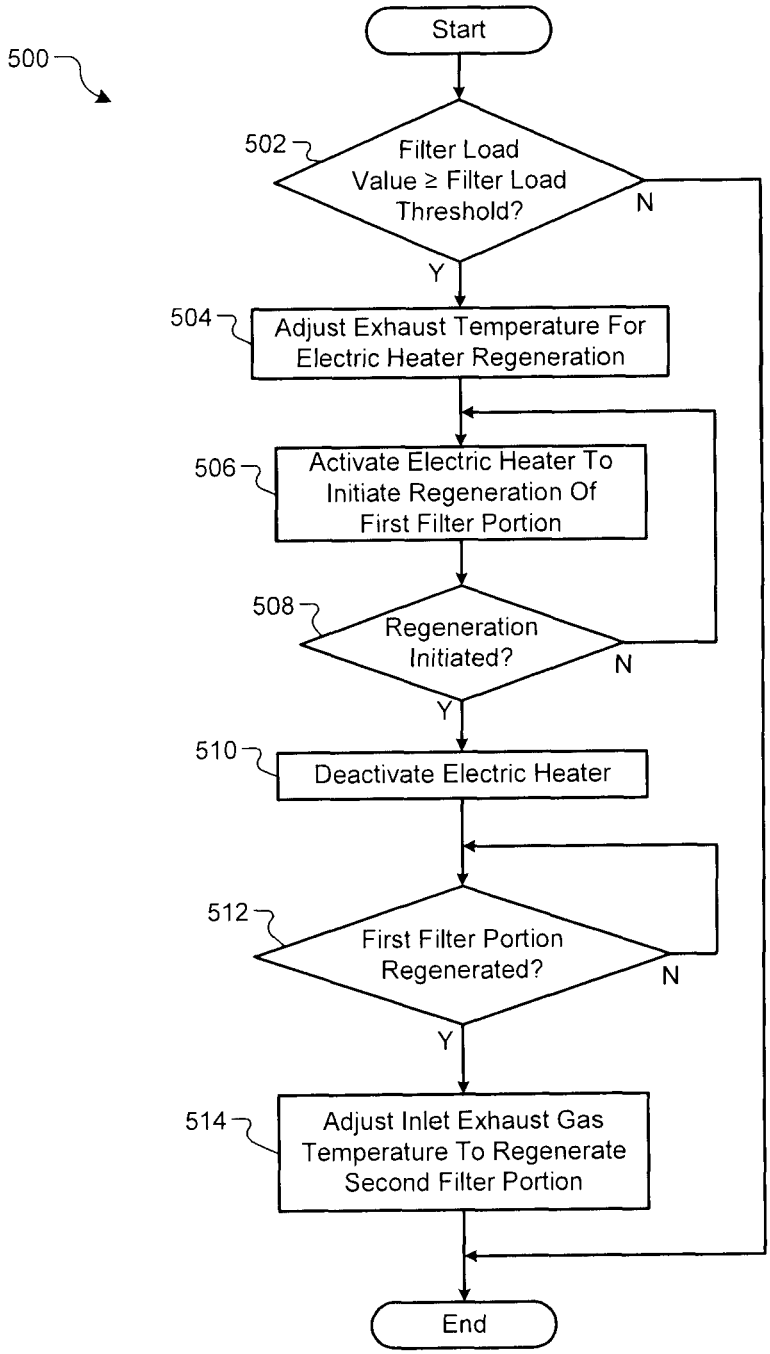
FIG. 7 is a flowchart depicting an exemplary method performed in the engine control module.

Referring now to FIG. 7, a flowchart 500 depicts exemplary steps of an engine control system according to the principles of the present disclosure. In step 502, control determines when the filter load value is greater than or equal to the filter load threshold. When the filter load value is greater than or equal to the filter load threshold, control continues to step 504. In step 504, control may adjust the inlet exhaust gas temperature to prepare for regeneration using the electric heater 58. For example only, control may increase the exhaust gas temperature to an electric regeneration temperature. For example only, the electric regeneration temperature may be approximately 450° C. In step 506, control activates the electric heater 58 to initiate regeneration in the first zone 74-1.

In step 508, control may determine whether regeneration of the first filter portion 70-1 has been initiated based on the zone temperature. The zone temperature may be measured by a temperature sensor. The zone temperature may be based on the inlet exhaust gas temperature and the heater temperature. The exhaust temperature sensor 66-2 may measure the inlet exhaust gas temperature. The heater temperature may be determined based on the power supplied to the electric heater 58. When control determines regeneration of the first filter portion 70-1 is initiated, control deactivates the electric heater 58 in step 510. Otherwise, control continues to activate the electric heater 58.

In step 512, control determines when the first filter portion 70-1 is regenerated. For example only, control may determine the first filter portion 70-1 completed regeneration after a predetermined period. When the first filter portion 70-1 completes regeneration, control proceeds to 514. In step 514, control adjusts the inlet exhaust gas temperature to regenerate the second filter portion 70-2. The inlet exhaust gas temperature may be greater than the PM combustion temperature. The inlet exhaust gas temperature may be greater than or equal to a temperature that causes damage to the PM filter 70 when the first filter portion 70-1 is full of PM. For example only, the inlet exhaust gas temperature may be greater than 650° C.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An exhaust treatment system comprising:

a particulate matter (PM) filter that receives exhaust gas of an engine and filters PM from the exhaust gas, wherein the PM filter includes M zones;

an electric heater arranged to cover a first one of the M zones but not other ones of the M zones, wherein the electric heater heats exhaust gas that is input to the first one of the M zones but not the other ones of the M zones, and wherein M is an integer greater than one; and a control module configured to i) adjust an exhaust temperature to a first predetermined temperature and activates the electric heater to initiate regeneration in the first one of the M zones, ii) deactivate the electric heater, and iii) after deactivating the electric heater, adjust the exhaust temperature to a second predetermined temperature that is greater than the first predetermined temperature to initiate regeneration in the other ones of the M zones, wherein the first one of the M zones includes an axially centered portion of the PM filter, and wherein the other ones of the M zones include a remaining portion of the PM filter surrounding the first one of the M zones.

2. The exhaust treatment system of claim 1, wherein the control module is configured to activate the electric heater for a predetermined period.

3. The exhaust treatment system of claim 1, wherein the control module is configured to activate the electric heater until PM in the first one of the M zones reaches a third predetermined temperature.

4. The exhaust treatment system of claim 1, wherein the second predetermined temperature causes PM in the other ones of the M zones to combust.

5. The exhaust treatment system of claim 1, wherein the second predetermined temperature is greater than 650° C.

6. A method comprising:

providing a particulate matter (PM) filter that receives exhaust gas of an engine and filters PM from the exhaust gas, wherein the PM filter includes M zones;

arranging an electric heater to cover a first one of the M zones but not other ones of the M zones, wherein the electric heater is arranged to heat exhaust gas that is input to N the first one of the M zones but not the other ones of the M zones, and wherein M is an integer greater than one;

adjusting an exhaust temperature to a first predetermined temperature;

activating the electric heater to initiate regeneration in the first one of the M zones;

deactivating the electric heater; and after deactivating the electric heater, adjusting the exhaust temperature to a second predetermined temperature that is greater than the first predetermined temperature to initiate regeneration in the other ones of the M zones, wherein the first one of the M zones includes an axially centered portion of the PM filter, and wherein the other ones of the M zones include a remaining portion of the PM filter surrounding the first one of the M zones.

7. The method of claim 6, further comprising activating the electric heater for a predetermined period.

8. The method of claim 6, further comprising activating the electric heater until PM in the first one of the M zones reaches a predetermined temperature.

9. The method of claim 6, wherein the second predetermined temperature causes PM in the other ones of the M zones to combust.

10. The method of claim 6, wherein the second predetermined temperature is greater than 650° C.

* * * * *